US006623344B2

(12) United States Patent
Inaba

(10) Patent No.: US 6,623,344 B2
(45) Date of Patent: Sep. 23, 2003

(54) WAFER POLISHING APPARATUS

(75) Inventor: Takao Inaba, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 6 days.

(21) Appl. No.: 09/789,885

(22) Filed: Feb. 21, 2001

(65) Prior Publication Data

US 2001/0024939 A1 Sep. 27, 2001

(30) Foreign Application Priority Data

Mar. 23, 2000 (JP) ..... 2000-082992

(51) Int. Cl.[7] ..... B24B 21/18
(52) U.S. Cl. ..... 451/443; 451/444
(58) Field of Search ..... 451/443, 444, 451/56, 285, 287, 288

(56) References Cited

U.S. PATENT DOCUMENTS

| | | | | |
|---|---|---|---|---|
| 5,584,751 A | | 12/1996 | Kobayashi et al. | |
| 5,904,615 A | * | 5/1999 | Jeong et al. | 451/443 |
| 6,126,530 A | * | 10/2000 | Hirata | 451/444 |
| 6,306,008 B1 | * | 10/2001 | Moore | 451/5 |
| 6,322,434 B1 | * | 11/2001 | Sato et al. | 451/443 |

FOREIGN PATENT DOCUMENTS

| | | |
|---|---|---|
| EP | 0 648 575 | 4/1995 |
| GB | 2 315 694 | 2/1998 |
| GB | 2 324 750 | 4/1998 |
| WO | WO 99/51398 | 10/1999 |

OTHER PUBLICATIONS

Combined Search and Examination Report dated Aug. 17, 2001 of corresponding British application.

* cited by examiner

*Primary Examiner*—Dung Van Nguyen
(74) *Attorney, Agent, or Firm*—Christie, Parker & Hale, LLP

(57) ABSTRACT

A dresser 44 of a wafer polishing apparatus according to this invention includes a grinding wheel head 444 that is idly supported in such a manner as to be capable of moving up and down relative to a dresser main body 441, and an air bag 449 interposed between the dresser main body and the grinding wheel head. The air pressure inside the air bag can be regulated so that the force pushing the grinding wheel head to the polishing cloth can be regulated. A washing tank 46 for washing the grinding wheel head of the dresser is disposed adjacent to the platen 41, and a brush table 463 having a brush 462 implanted thereto is detachably provided to the bottom part of the washing tank 46.

12 Claims, 4 Drawing Sheets

WAFER POLISHING APPARATUS

CROSS-REFERENCE TO RELATED APPLICATION

This application claims priority of Japanese patent application number 2000-082992, filed Mar. 23, 2000.

BACKGROUND OF THE INVENTION

1. Field of the Invention

This invention relates to a wafer polishing apparatus. More particularly, this invention relates to a polishing apparatus for polishing semiconductor wafers using chemical mechanical polishing (CMP).

2. Description of the Related Art

Miniaturization of ICs (integrated circuits) has made progress in recent years, and IC patterns are being formed in multiple layers. A surface of a layer on which such a pattern is formed unavoidably has an unevenness to a certain extent. The prior art technology forms, as such, a pattern on a previous layer. However, the greater the number of layers and the smaller the widths of lines and the diameters of holes, the more difficult it becomes to form satisfactory patterns and the more likely it becomes for defects to occur. Therefore, it is a customary practice to planarize the surface of a layer having a pattern formed thereon and then to form the pattern of a next layer. A wafer polishing apparatus (CMP apparatus) using a CMP method has been employed for polishing a wafer during the formation process of an IC pattern.

The wafer polishing apparatus includes a disc-like polishing table (platen) having a polishing cloth (polishing pad) bonded to one of the surfaces thereof, a plurality of polishing heads each holding one of the surfaces of a wafer to be polished and bringing the other surface of the wafer into contact with the polishing cloth, and a head driving mechanism for relatively rotating these polishing heads on the polishing table. The wafer is polished as a slurry containing abrasive particles is supplied between the polishing cloth and the wafer.

The polishing cloth is generally made of a polyurethane, or the like, having flexibility. As the polishing operation proceeds, wear or clogging occurs in the surface of the polishing cloth, and problems such as degradation and smoothening of the polishing cloth, and a drop in its polishing efficiency, occur.

Therefore, the wafer polishing apparatus according to the prior art is equipped with a dresser for regulating the surface of the polishing cloth so as to cope with the wear of the surface of the polishing cloth, adhesion of polishing chips or clogging by the slurry during the polishing operation. When the surface of the polishing cloth must be regulated, a grinding wheel head of the dresser is brought into contact with the polishing cloth to prevent clogging of the polishing cloth.

This regulation processing of the polishing cloth is generally referred to as "conditioning processing" of the polishing cloth. The conditioning processing is conducted when a new polishing cloth is fitted to replace the used polishing cloth with degradation of the polishing cloth. This is because, the surface of the new polishing cloth is not sufficiently compatible with the slurry, and the polishing condition is different between the new polishing cloth and the polishing cloth used to certain a extent, causing a difference in the wafer condition after polishing. To avoid this problem, an initialization processing is carried out to regulate the surface of the new polishing cloth by polishing a dummy wafer for a certain period of time when the new polishing cloth is used afresh.

The grinding wheel head of the conventional dresser is fixedly mounted to a main body of the dresser, and cannot therefore conduct regulation in conformity with the surface condition of the polishing cloth. Therefore, if the polishing cloth has any undulation, dressing cannot be conducted under the constant condition, a polishing ratio does not become constant, and the processing condition of the surface of the wafer does not become uniform.

SUMMARY OF THE INVENTION

In view of the problems described above, it is therefore an object of the present invention to provide a wafer polishing apparatus equipped with a dresser capable of conducting a dressing operation under a constant condition in conformity with a surface of a polishing cloth.

A wafer polishing apparatus according to one aspect of the present invention includes pushing means for idly supporting a grinding wheel head in such a manner as to be capable of moving inside a dresser main body, and capable of regulating a pushing force of the grinding wheel head to a polishing cloth. Therefore, regulation can be made in conformity with the surface of the polishing cloth under a constant dressing condition and eventually, the surface of a wafer can be polished uniformly.

A wafer polishing apparatus according to another aspect of the present invention stipulates that the pushing means is an air bag, and its function and effect is substantially the same as that of the wafer polishing apparatus described above.

A wafer polishing apparatus according to still another aspect of the invention includes a washing tank for grinding wheel heads, disposed adjacent to a platen. Since the grinding wheel heads are immersed in washing water inside the washing tank during polishing of the wafer, that is, during a non-conditioning work, drying of slurry adhering to the grinding wheel heads can be prevented and the slurry can be washed away. In this way, the conditioning work can be carried out satisfactorily.

A wafer polishing apparatus according to still another aspect of the invention includes a brush that is detachably fitted to a bottom part of the washing tank. Consequently, washing of the grinding wheel heads can be conducted more satisfactorily, and the brush can be exchanged easily.

The present invention may be more fully understood from the description of the preferred embodiment of the invention set forth below together with the accompanying drawings.

DESCRIPTION OF THE PREFERRED EMBODIMENT

A wafer polishing apparatus according to a preferred embodiment of the present invention is now explained with reference to the accompanying drawings.

Figure 1:
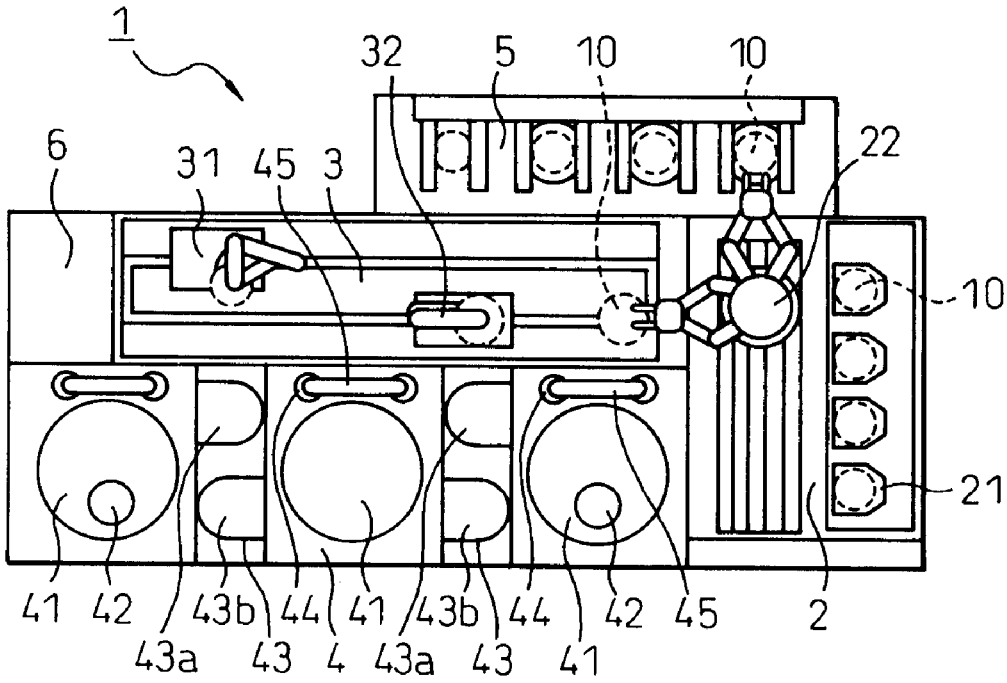
FIG. 1 is a schematic plan view of an overall construction of a wafer polishing apparatus according to an embodiment of the present invention.

FIG. 1 is a schematic plan view showing an overall construction of a wafer polishing apparatus according to the present invention. The wafer polishing apparatus 1 comprises five units, that is, an index unit 2, a load/unload unit 3, a polishing unit 4, a washing unit 5 and an electric installation unit 6. Fitting devices individually fit each of these units.

The index unit 2 is constituted so that a plurality of cassettes 21 can be loaded. A robot 22 is fitted to the index unit 2 so as to take out the wafers 10 accommodated in the cassettes 21 and to carry them to the load/unload unit 3. The robot 22 receives the wafers 10 after polishing and washing from the washing unit 5, and returns them into the respective cassettes 21.

The load/unload unit 3 includes, above and below, two transfer robots 31 and 32. The upper-stage transfer robot 31 is used for loading while the lower-stage transfer robot 32 is used for unloading. Each wafer 10 from the index unit 2 is delivered to the upper-stage transfer robot 31. A pre-alignment table inside the load/unload unit 3, not shown, executes centering, and the wafer 10 is then conveyed to the polishing unit 4.

The polishing unit 4 includes three platens 41 and two polishing heads 42. A waiting unit 43 having wafer placement tables having an upper-lower two-stage structure is disposed between the respective platens. Each wafer placement table 43*a*, 43*b* can linearly move between a position at which it exchanges the wafer 10 with the load/unload unit 3 and a position at which it exchanges the wafer 10 with the polishing head 42. Each wafer 10 conveyed to the polishing unit 4 is carried by the polishing heads 42 onto the platen 41 through the upper-stage wafer placement table 43*a* of the waiting unit 43 and is polished there. After polishing, the wafer 10 is taken out by the lower-stage transfer robot 32 of the load/unload unit 3 again through the lower-stage wafer placement table 43*b* of the waiting unit 43, and is then conveyed to the washing unit 5.

After washing is complete, the robot 22 of the index unit 2 puts the wafer 10 into the cassette 21. The above explains the outline of the processing steps of the wafer polishing apparatus 1 shown in FIG. 1.

Figure 2:
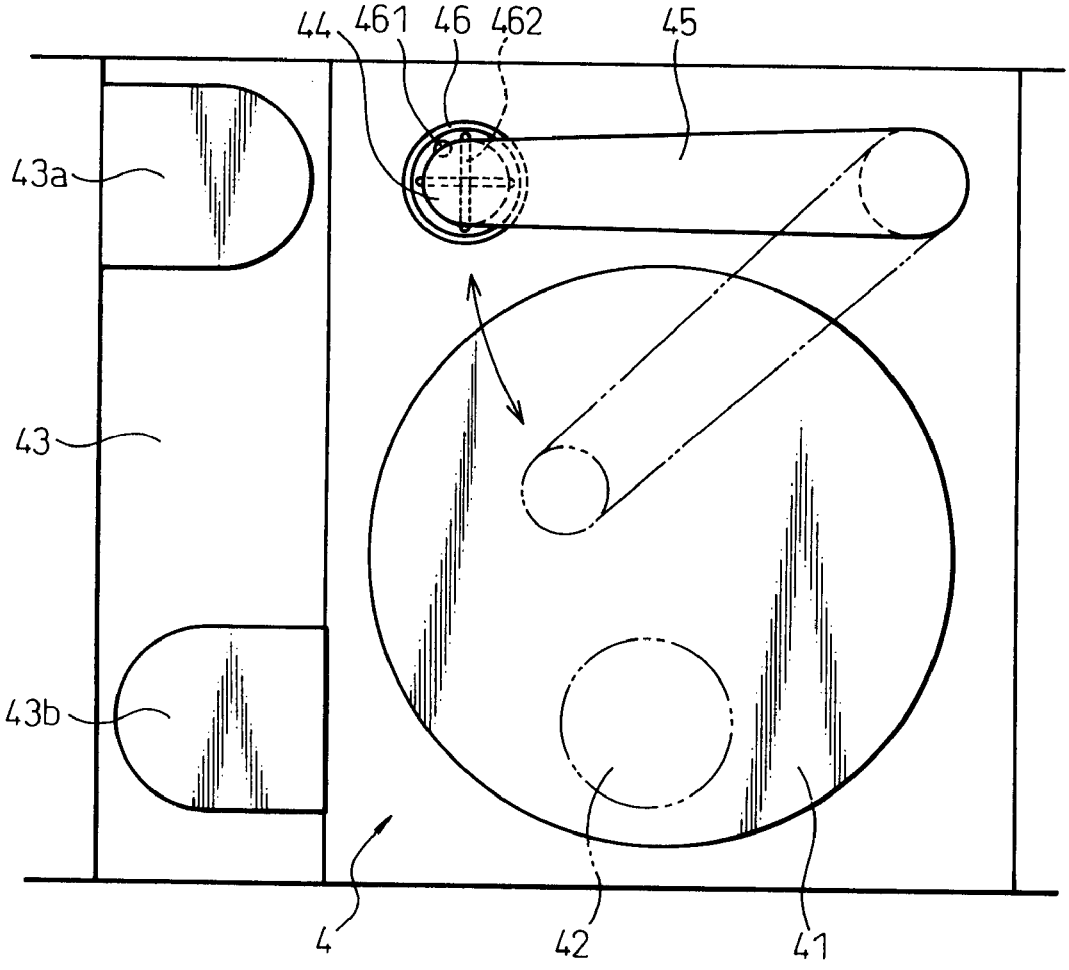
FIG. 2 is a plan view useful for explaining the position and movement of a dresser of a wafer polishing apparatus according to the present invention.

Next, the construction of a dresser 44 as the feature of the wafer polishing apparatus of the present invention is explained in detail with reference to FIGS. 2 and 3. As shown in FIG. 2, the dresser 44 is provided to the polishing unit 4, and can be rotated by an arm 45 between a non-conditioning work position and a conditioning work position away from the platen 41. The dresser 44 and the arm 45 can be moved up and down integrally with each other by an elevation mechanism, not shown in the drawing.

Figure 3:
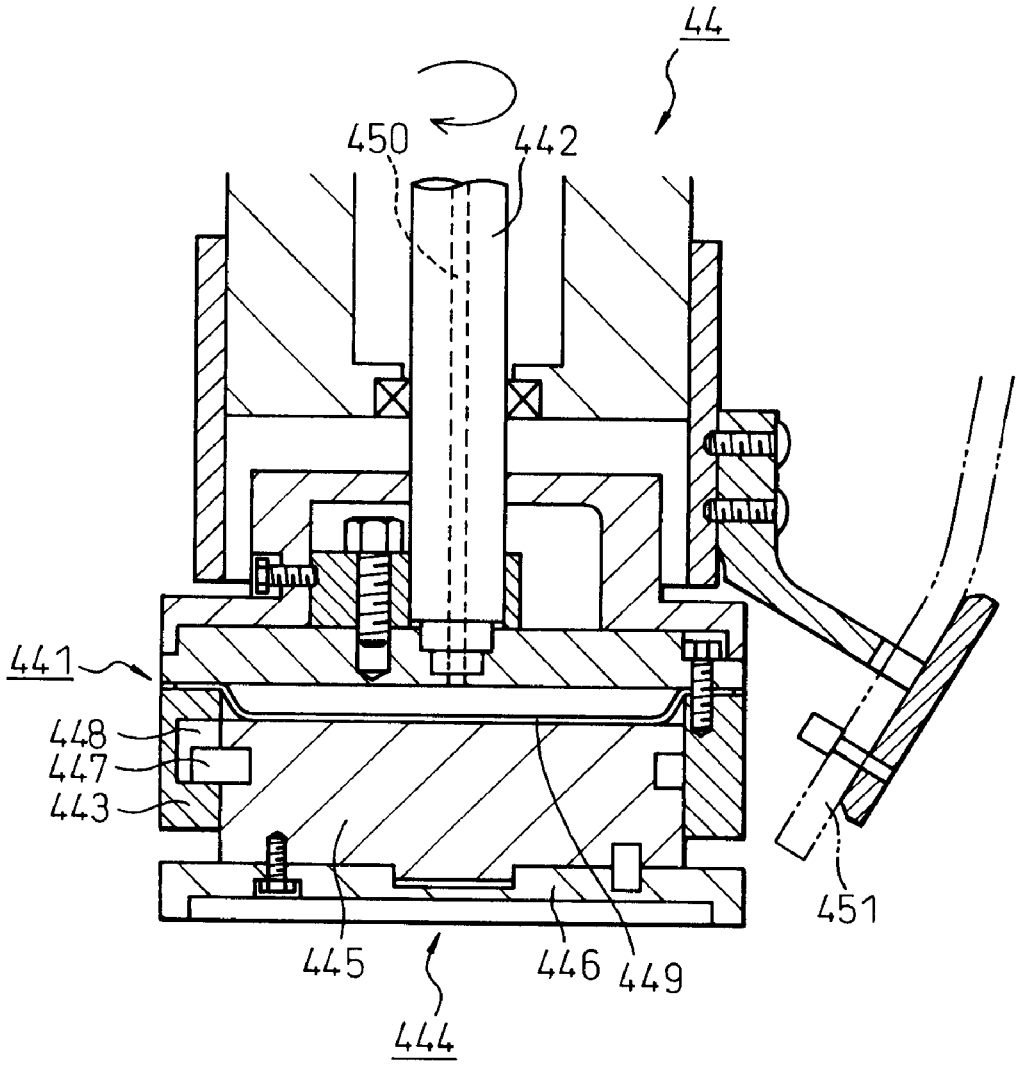
FIG. 3 is a longitudinal sectional view of the dresser of the present invention.
Figure 4:
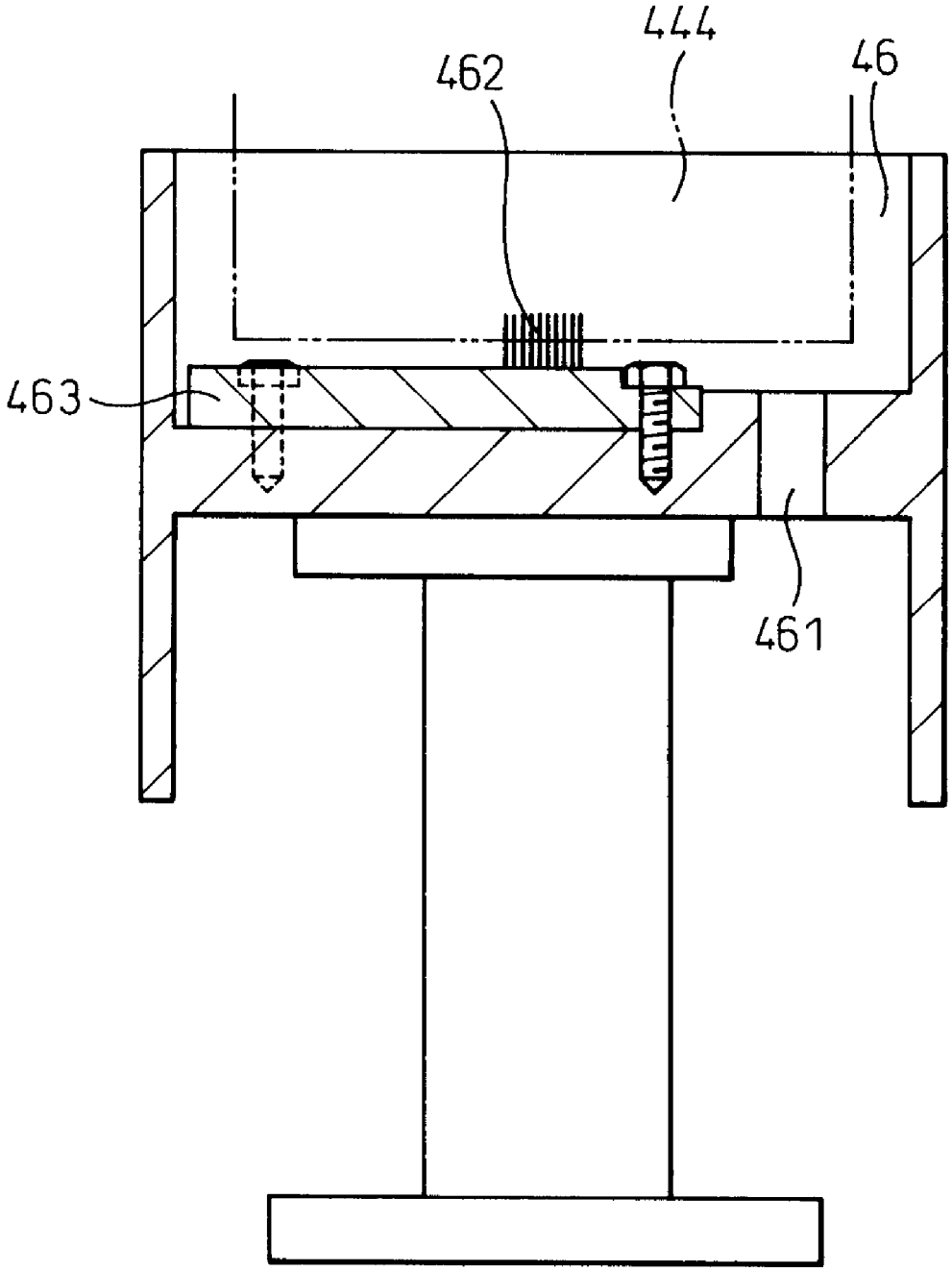
FIG. 4 is a longitudinal sectional view of a washing tank for washing the dresser.

As shown in FIG. 3, a dresser main body 441 is fixed to a driving shaft 442 and rotates with this driving shaft 442. Cylindrical side members 443 of the dresser main body 441 support a cylindrical grinding wheel head 444 so that it can move up and down inside a space defined by the side members 443.

The grinding wheel head 444 comprises a head main body 445 and a grinding wheel 446. These constituent members are fixed by bolts. Several pins 447 are implanted to the same height to the peripheral side surface of the head main body 445. The pins 447 are accommodated in a plurality of longitudinal grooves 448 formed in the inner peripheral surface of the cylindrical side members 443 of the dresser main body 441 in such a fashion as to be capable of moving vertically.

Pushing means for pushing the grinding wheel head 444 to a polishing cloth on the platen 41 is interposed between the dresser main body 441 and the head main body 445 of the grinding wheel head. The pushing means is, for example, an air bag 449 formed of a sheet-like rubber or resin, as shown in FIG. 3. Air for inflating and contracting the air bag 449 is supplied through an air passage 450 defined inside the driving shaft 442, for example. The air pressure inside the air bag can be regulated by suitable means, not shown, and the pushing force of the grinding wheel head 444 to the polishing cloth can thus be regulated.

Furthermore, the dresser 44 includes rinsing water feed means 451 for supplying rinsing water to a processed surface during the conditioning work, provided to the front part thereof.

A cylindrical washing tank 46 for washing the grinding wheel head 444 of the dresser 44 is disposed at a corner of the polishing unit adjacent to the platen 41. The washing tank 46 can accommodate therein the dresser main body 441. A feed port 461 of washing water is formed at the bottom of this tank 46. A brush table 463 having a brush 462 implanted thereto is fixed by bolts to the bottom of the tank 46, whenever necessary. The implantation shape of the brush is suitably crisscross, for example. Washing water flows out from the upper part of the washing tank 46.

Next, the operation of the dresser 44 having the construction described above is explained.

The grinding wheel head 444 of the dresser 44 is kept immersed in washing water inside the washing tank 46 during the non-conditioning work of the dresser 44 such as during polishing of the wafer 10. Therefore, the slurry adhering to the grinding wheel head 444 is washed away or, even when it is not, the slurry does not become dry.

As the wafer polishing operation is repeatedly carried out, the polishing cloth on the platen is deteriorated and becomes smooth due to wear or clogging, thereby lowering polishing efficiency. In this case, the conditioning work by the dresser 44 becomes necessary, and the polishing operation of the wafer 10 is stopped.

Next, the dresser 44 moves up and down and rotates from the position of the washing tank 46, carries the grinding wheel head 444 onto the platen 41 and pushes it to the polishing cloth. At the same time, the rinsing water feed means 451 supplies rinsing water to the conditioning processed surface, and the platen 41 and the dresser main body 441 rotate, thereby executing the conditioning work of the polishing cloth. The pushing force of the grinding wheel head 441 to the polishing cloth is appropriately regulated at this time. After the conditioning work is complete, the dresser main body 441 returns to its original position inside the washing tank 46.

In the wafer polishing apparatus according to the present invention described above, the grinding wheel head of the dresser can move up and down and can regulate the pushing force to the polishing cloth. Therefore, regulation can be made in conformity with the surface condition of the polishing cloth, and the dressing condition of the polishing cloth can be rendered constant. As a result, the processing condition of the wafer surface can be made uniform.

While the present invention has thus been described by reference to a specific embodiment chosen for purposes of illustration, it should be apparent that numerous modifications could be made thereto by those skilled in the art without departing from the basic concept and scope of the invention.

What is claimed is:

1. A wafer polishing apparatus including a dresser for regulating a condition of a polishing cloth disposed on a surface of a platen for polishing a wafer, wherein:

said dresser comprises a grinding wheel head idly supported inside a dresser main body in such a manner as to be capable of moving in a vertical direction, and pushing means for pushing said grinding wheel head to said polishing cloth by means of an air pressure inside an air bag which is interposed between said dresser main body and said grinding wheel head, and is formed from a material selected from the group consisting of rubbers and resins, said air bag receiving air pressure from an air source.

2. A wafer polishing apparatus according to claim 1, wherein the air pressure in said air bag can be regulated.

3. A wafer polishing apparatus according to claim 2, wherein a washing tank for washing said grinding wheel head is disposed adjacent to said platen.

4. A wafer polishing apparatus according to claim 4, wherein a brush is detachably provided to a bottom part of said washing tank.

5. A wafer polishing apparatus according to claim 1, wherein a washing tank for washing said grinding wheel head is disposed adjacent to said platen.

6. A wafer polishing apparatus according to claim 3, wherein a brush is detachably provided to a bottom part of said washing tank.

7. A wafer polishing apparatus comprising:

a platen;

a dresser for regulating a condition of a polishing cloth disposed on a surface of the platen for polishing a wafer, the dresser comprising a grinding wheel head, the grinding wheel head being idly supported inside a main body of the dresser in such a manner as to be capable of moving in a vertical direction; and an air bag interposed between said dresser main body and said grinding wheel head, the air bag being responsive to air pressure applied thereto from an air source, the air bag being formed from a material selected from the group consisting of rubbers and resins.

8. A wafer polishing apparatus according to claim 7, wherein the air pressure applied to the air bag while said grinding wheel head is pushed to said polishing cloth can be regulated.

9. A wafer polishing apparatus according to claim 8, comprising a washing tank for washing said grinding wheel head, the washing tank being disposed adjacent to said platen.

10. A wafer polishing apparatus according to claim 9, comprising a brush detachably provided to a bottom part of said washing tank.

11. A wafer polishing apparatus according to claim 7, comprising a washing tank for washing said grinding wheel head is disposed adjacent to said platen.

12. A wafer polishing apparatus according to claim 11, comprising a brush detachably provided to a bottom part of said washing tank.

* * * * *